US011578738B1

(12) United States Patent
Du

(10) Patent No.: US 11,578,738 B1
(45) Date of Patent: Feb. 14, 2023

(54) VORTEX WATER FLOW ACCELERATOR

(71) Applicant: Yongzhen Du, Shenzhen (CN)

(72) Inventor: Yongzhen Du, Shenzhen (CN)

( * ) Notice: Subject to any disclaimer, the term of this patent is extended or adjusted under 35 U.S.C. 154(b) by 0 days.

(21) Appl. No.: 17/846,045

(22) Filed: Jun. 22, 2022

(51) Int. Cl.
*F15D 1/02* (2006.01)
*F15D 1/00* (2006.01)

(52) U.S. Cl.
CPC ..... *F15D 1/0015* (2013.01)

(58) Field of Classification Search
CPC ..... F15D 1/0015
USPC ..... 138/39, 42, 44
See application file for complete search history.

(56) References Cited

U.S. PATENT DOCUMENTS 1,648,708 A * 11/1927 Wilkinson ..... G01F 1/40 138/40
1,662,178 A * 3/1928 Yuille ..... E02F 7/10 37/336
1,664,967 A * 4/1928 Christensen ..... F23K 5/18 138/40
1,803,126 A * 4/1931 Oberhuber ..... F28G 1/12 138/40
3,266,437 A * 8/1966 Blackmore ..... F04D 29/708 415/121.2
3,636,983 A * 1/1972 Keyser ..... F15D 1/02 138/39
5,315,859 A * 5/1994 Schommer ..... F15D 1/00 73/1.25
6,357,483 B1 * 3/2002 Kobayashi ..... E03C 1/08 138/40
6,523,572 B1 * 2/2003 Levin ..... F15D 1/0005 366/337
7,347,223 B2 * 3/2008 Richter ..... F15D 1/02 138/37
10,458,446 B1 * 10/2019 Schmidt ..... B01F 25/4314
2013/0306183 A1 * 11/2013 Sawchuk ..... F15D 1/02 138/44

(Continued)

*Primary Examiner* — James F Hook
(74) *Attorney, Agent, or Firm* — Rumit Ranjit Kanakia

(57) ABSTRACT

A vortex water flow accelerator comprises a joint pipe with a water inlet and a water outlet, a water outlet barrel connected to one end of the joint pipe, and a plurality of spiral blades arranged in the water outlet barrel and connected with the joint pipe, wherein the size of the water outlet is smaller than that of the water inlet, and the inner wall of the joint pipe sequentially forms an annular surface and a first conical surface along a direction from the water inlet to the water outlet, and the outer wall of the joint pipe is formed with a second conical surface, on which a plurality of splitter plates uniformly distributed at the circumference are formed; the splitter plate protrudes from the water outlet end face of the joint pipe, the water outlet barrel has a small diameter end and a large diameter end, and the small diameter end is connected to the splitter plate, so that a secondary water inlet is formed between the second conical surface, the water outlet barrel and two adjacent splitter plates; the water outlet is smaller than the water inlet, the cross-section decreases to increase the flow velocity of the water flow passing through; the first conical surface can well reduce the resistance to the water flow, maximizing the increase of the flow velocity, while the secondary water inlet simultaneously feeds water to further increase the water volume, and the second conical surface also gives the minimum resistance to the water flow.

4 Claims, 5 Drawing Sheets

(56) References Cited

U.S. PATENT DOCUMENTS

2014/0373955 A1* 12/2014 Fraser ..... C02F 1/325
138/44
2019/0060846 A1* 2/2019 Juan ..... B01F 25/3121

* cited by examiner

VORTEX WATER FLOW ACCELERATOR

TECHNICAL FIELD

The present application relates to a vortex water flow accelerator.

BACKGROUND

Vortex water flow accelerators are common in fish culture tanks. The vortex water flow accelerator is usually connected to the nozzle of the water outlet pipe of a suction pump. The flow rate of the water in the water outlet pipe is increased and produces a swirl effect under the function of the vortex water flow accelerator, which can increase the water circulation and enhance the filtration effect. The existing vortex water flow accelerator has a simple structure, in which usually only a plurality of spiral blades are arranged in the direction of water flow, and the water flows through the spiral blades to form vortex water; the existing vortex water flow accelerator can play the function of acceleration, but the acceleration effect is not very good, so it needs to be further improved by structural optimization.

SUMMARY

In view of the shortcomings of the above problems, the present application provides a vortex water flow accelerator.

In order to achieve the above purpose, the present application provides a vortex water flow accelerator, which includes a joint pipe with a water inlet and a water outlet, a water outlet barrel connected to a water outlet end of the joint pipe, and a plurality of spiral blades arranged in the water outlet barrel and connected with the joint pipe, wherein the water inlet is connectable with a water outlet pipe of a suction pump, the size of the water outlet is smaller than that of the water inlet, and an inner wall of the joint pipe forms an annular surface and a first conical surface in turn from along a direction from the water inlet to the water outlet, and an outer wall of the joint pipe is formed with a second conical surface on which a plurality of splitter plates uniformly distributed at the circumference are formed; the splitter plates protrude from a water outlet end face of the joint pipe, the water outlet barrel has a small diameter end and a large diameter end, and the small diameter end is connected to the splitter plates, so that a secondary water inlet is formed between the second conical surface, the water outlet barrel and two adjacent splitter plates; an upper edge of the spiral blade (3) is attached to the splitter plate, and an outer edge of the spiral blade (3) is attached to an inner wall of the water outlet barrel; a lower edge of the spiral blade (3) extends to the position of the large diameter end (22), and an inner edge of the spiral blade (3) is spirally bent and retracted from the circumference of the water outlet (12) to the center of a circle.

The size of the outlet is smaller than that of the inlet, and the cross-section decreases, so that the flow velocity increases. The first conical surface can well reduce the resistance to water flow, so that the flow velocity increases to the maximum. The second conical surface also gives the minimum resistance to water flow, and the spiral blades are spirally bent and retracted, so that after the water at the inlet and the water at the secondary inlet enter the outlet barrel, the two parts of water interact with each other to form a larger vortex, which results in a large amount of water and a large flow velocity.

As a further improvement of the solution, a locking interface is formed on the splitter plate, and the small diameter end is positioned and installed at the locking interface.

In the above technical solution, the design of the locking interface makes the assembly of the water outlet barrel simple.

As a further improvement of the solution, a middle part of the water outlet barrel retracts inward in a thin waist shape.

In the above technical solution, the design of the thin waist makes the spiral blade have a longer path when bending in the water outlet barrel, and the water flow forms a larger vortex under the action of the spiral blade.

As a further improvement of the solution, a thickness of the spiral blade decreases along a direction from the upper edge to the lower edge.

In the above technical solution, the gradual design of the thickness further promotes the formation of vortex water flow.

Compared with the prior art, the present application has the beneficial effects that the size of the water outlet is smaller than that of the water inlet, and the cross section is reduced to increase the flow velocity; the first conical surface can well reduce the resistance to the water flow, so that the flow velocity increases to the maximum; the second conical surface also gives the minimum resistance to the water flow; and the spiral blades are spirally bent and retracted, so that after the water at the water inlet and the water at the secondary water inlet enter the water outlet barrel, the two parts of water interact to form a larger vortex.

Figure 1:
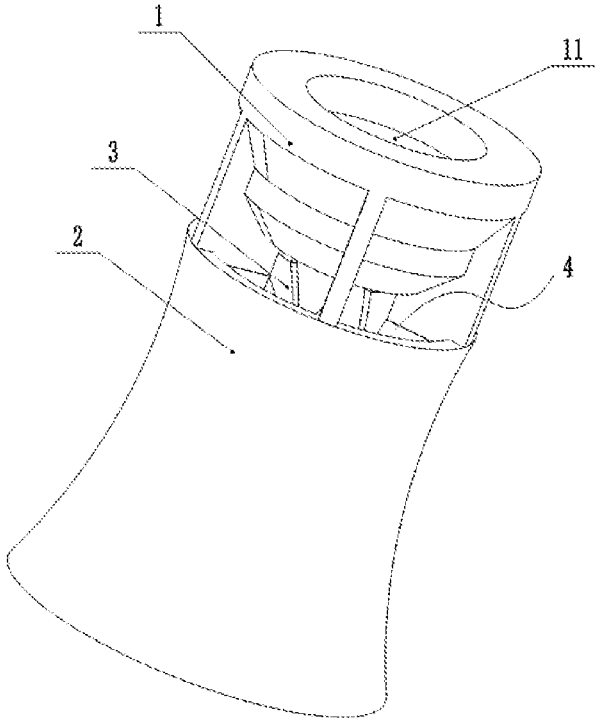
FIG. 1 is a perspective view of a vortex water flow accelerator of the present application.

In the drawings: 1. Joint pipe; 11. Water inlet; 12. Water outlet; 13. Annular surface; 14. First conical surface; 15. Second conical surface; 16. Splitter plate; 17. Locking interface; 2. Water outlet barrel; 21. Small diameter end; 22. Large diameter end; 3. Spiral blade; 4. Secondary water inlet.

DESCRIPTION OF EMBODIMENTS

Figure 2:
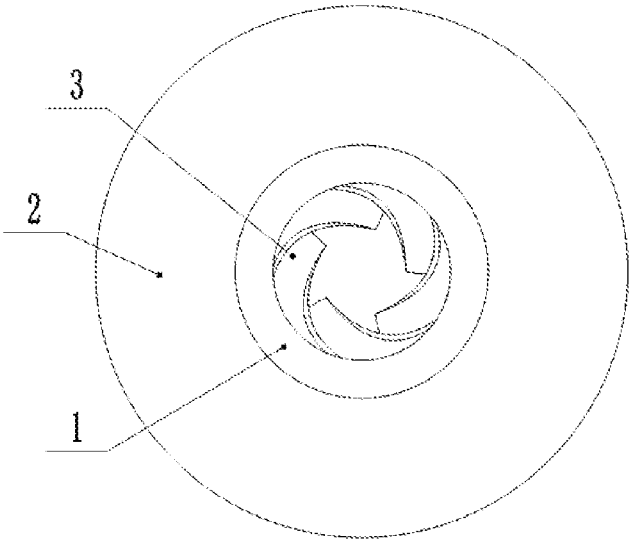
FIG. 2 is a plan view of a vortex water flow accelerator according to the present application.
Figure 3:
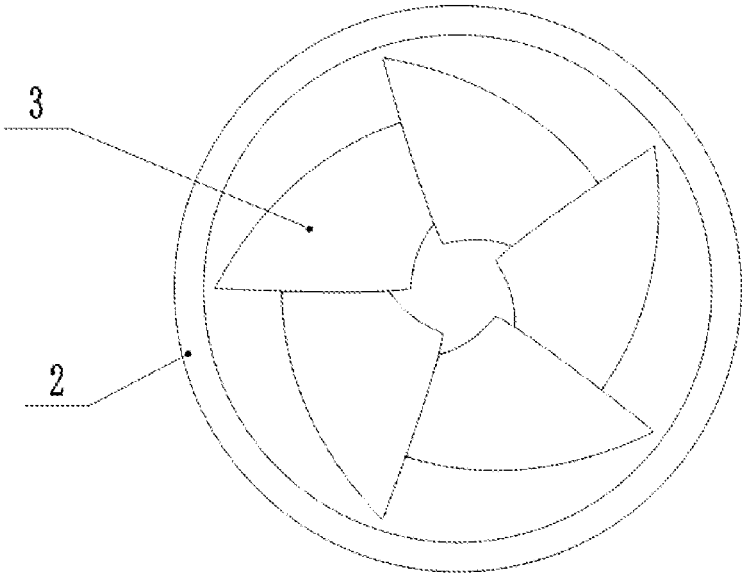
FIG. 3 is a bottom view of a vortex water flow accelerator according to the present application.
Figure 4:
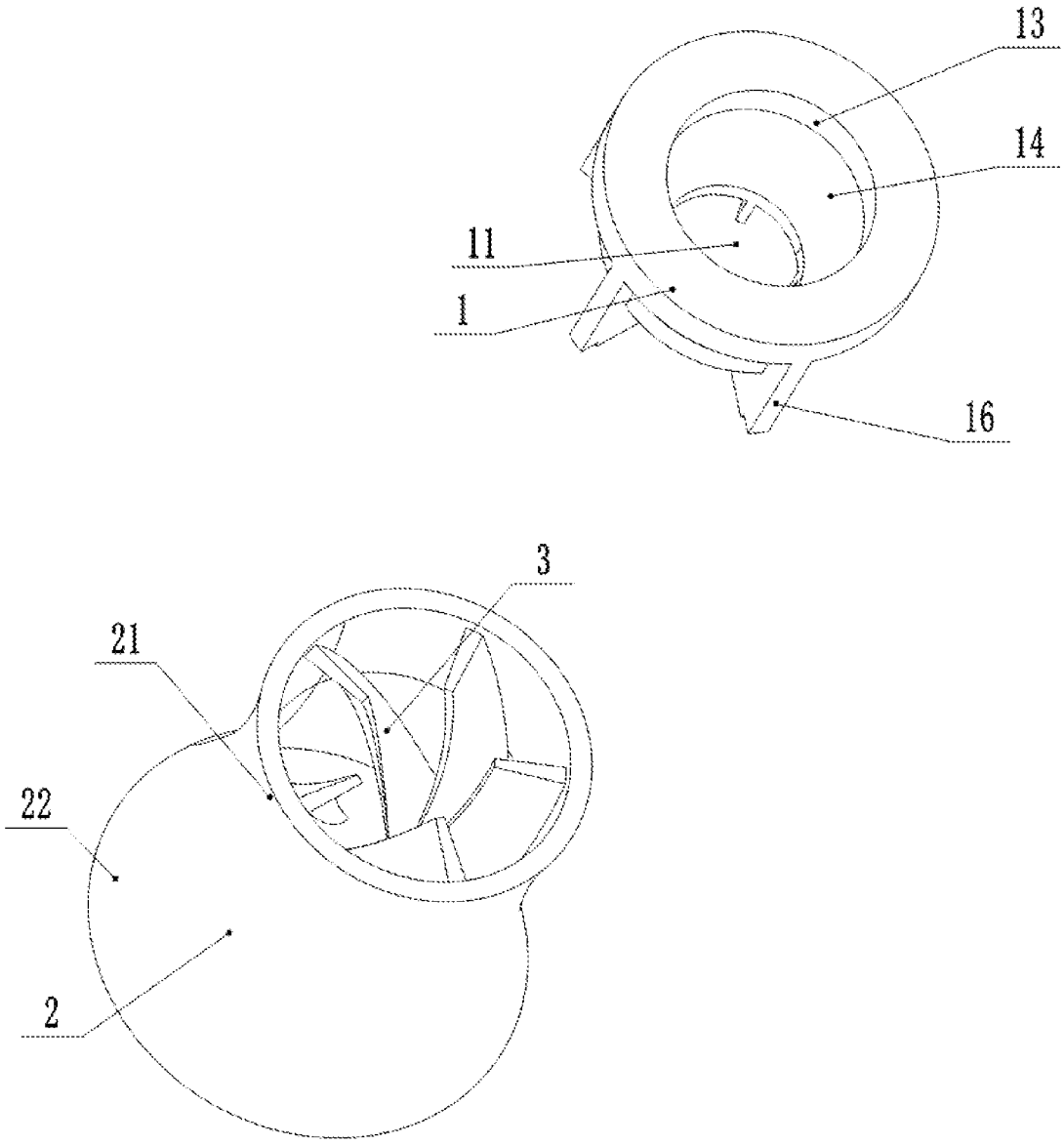
FIG. 4 is an explosion diagram of a vortex water flow accelerator of the present application.
Figure 5:
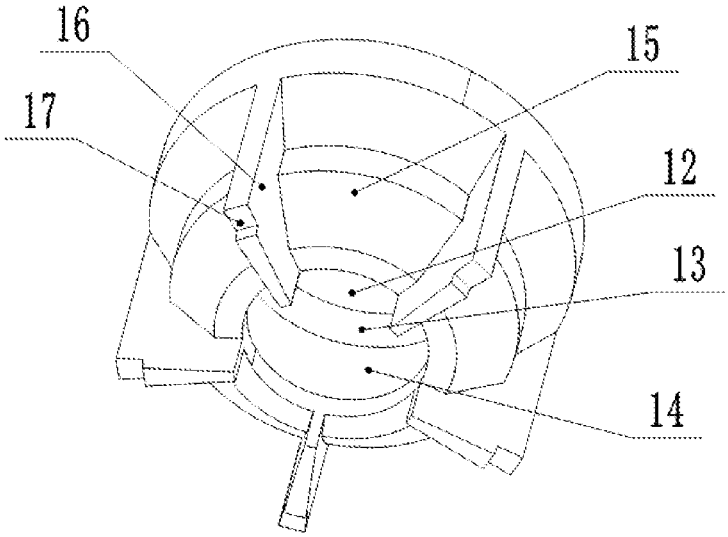
FIG. 5 is a schematic diagram of the related joint pipe.

As shown in FIGS. 1-5, a vortex water flow accelerator according to the embodiment of the present application includes a joint pipe 1 with a water inlet 11 and a water outlet 12, a water outlet barrel 2 connected to a water outlet end of the joint pipe 1, and a plurality of spiral blades 3 arranged in the water outlet barrel 2 and connected with the joint pipe 1, wherein the water inlet 11 is connectable with a water outlet pipe of a suction pump, the size of the water outlet 12 is smaller than that of the water inlet 11, and an inner wall of the joint pipe 1 forms an annular surface 13 and a first conical surface 14 in turn from along a direction from the water inlet 11 to the water outlet 12, and an outer wall of the joint pipe is formed with a second conical surface 15 on which a plurality of splitter plates 16 uniformly distributed at the circumference are formed; the splitter plates 16 protrude from a water outlet end face of the joint pipe, the water outlet barrel 2 has a small diameter end 21 and a large diameter end 22, and the small diameter end 21 is connected to the splitter plates 16, so that a secondary water inlet 4 is formed between the second conical surface 15, the water outlet barrel 2 and two adjacent splitter plates 16; an upper edge of the spiral blade 3 is attached to the splitter plate 16, and an outer edge of the spiral blade 3 is attached to an inner wall of the water outlet barrel 2; a lower edge of the spiral blade 3 extends to the position of the large diameter end 22, and an inner edge of the spiral blade 3 is spirally bent and retracted from the circumference of the water outlet 12 to the center of a circle; a locking interface 17 is formed on the splitter plate 16, and the small diameter end 21 is positioned and installed at the locking interface 17; the design of the locking interface makes the assembly of the water outlet barrel simple; a middle part of the water outlet barrel 2 retracts inward in a thin waist shape; the design of the thin waist makes the spiral blade have a longer path when bending in the water outlet barrel, and the water flow forms a larger vortex under the action of the spiral blade; a thickness of the spiral blade decreases along a direction from the upper edge to the lower edge; the gradual design of the thickness further promotes the formation of vortex water flow.

The size of the outlet is smaller than that of the inlet, and the cross-section decreases, so that the flow velocity increases. The first conical surface can well reduce the resistance to water flow, so that the flow velocity increases to the maximum. The second conical surface also gives the minimum resistance to water flow, and the spiral blades are spirally bent and retracted, so that after the water at the inlet and the water at the secondary inlet enter the outlet barrel, the two parts of water interact with each other to form a larger vortex, which results in a large amount of water and a large flow velocity.

When in use, in order to facilitate the understanding of the present application, it is described with reference to the attached drawings.

The water flow enters from the water inlet of the joint pipe, and passes through the annular surface 13 and the first conical surface 14 to the water outlet. As the cross-section decreases, the water flow speed increases, and the resistance of the first conical surface to the water flow is small. The accelerated water flows through the water outlet and impacts the lower half of the spiral blade, forming a high-speed vortex along the surface of the spiral blade, while in the upper half of the spiral blade, a negative pressure is formed. The negative pressure makes the external water enter from the secondary water inlet, and the water volume increases. The resistance of the second cone to the water flow is small, and the water entering from the secondary water inlet flows along the upper part of the spiral blade to form a vortex in advance, which drives the water flowing through the water outlet to rotate, so that part of the water flowing through the water outlet spreads outward to the upper half of the spiral blade before impacting the lower half of the spiral blade, that is, a certain air swirl is formed in the middle of a plurality of spiral blades, and the water flowing from the water outlet and the secondary water inlet interact with each other to form a larger vortex on the circumference and an air swirl at the center of the circle, which greatly increases the flow rate of the water flowing out of the water outlet barrel.

The above is only the preferred embodiment of the present application, and it is not intended to limit the present application. For those skilled in the art, the present application can be modified and varied. Any modification, equivalent substitution, improvement, etc. made within the spirit and principle of the present application shall be included in the scope of protection of the present application.

What is claimed is:

1. A vortex water flow accelerator, comprising:

a joint pipe with a water inlet and a water outlet, a water outlet barrel connected to a water outlet end of the joint pipe, and a plurality of spiral blades arranged in the water outlet barrel and connected with the joint pipe, wherein the water inlet is connectable with a water outlet pipe of a suction pump, the size of the water outlet is smaller than that of the water inlet so that so as to increase a flow velocity, and an inner wall of the joint pipe forms an annular surface and a first conical surface in turn from along a direction from the water inlet to the water outlet, and an outer wall of the joint pipe is formed with a second conical surface, the outer wall of the joint pipe defines a circumference on which the second conical surface is formed;

a plurality of splitter plates uniformly distributed and formed at the circumference; the plurality of splitter plates protrudes from a water outlet end face of the joint pipe, the water outlet barrel has a small diameter end and a large diameter end, and the small diameter end is connected to the plurality of splitter plates, so that a secondary water inlet is formed between the second conical surface, the water outlet barrel and two adjacent splitter plates;

an upper edge of the spiral blade is attached to the splitter plate, and an outer edge of the spiral blade is attached to an inner wall of the water outlet barrel; a lower edge of the spiral blade extends to the position of the large diameter end, and an inner edge of the spiral blade is spirally bent and retracted from the circumference of the water outlet to the center of a circle, wherein the water inlet is axially formed so that a first flow of water from a water surrounding that enter at the water inlet passes through a decreasing cross-section flowing from the annular surface and the first conical surface to the water outlet to obtain accelerated water flows through the water outlet and impacts a lower part of the spiral blade, forming a first vortex along a surface of the spiral blade, which in an upper edge of the spiral blade, a negative pressure is formed, and wherein the negative pressure makes a second flow of water from the water surrounding to enter from the secondary water inlet formed circumferentially to receive additional water volume in the water outlet barrel, from that of a water volume by the first flow of water, wherein the second flow of water flows along an upper part of the spiral blade to form a second vortex in advance than that of the first vortex, wherein the second vortex drives the water flowing through the water outlet to rotate, so that a part of the water flowing through the water outlet spreads outward to the upper half of the spiral blade before impacting the lower half of the spiral blade to form an air swirl in the middle of the plurality of spiral blades, and the water flowing from the water outlet and the secondary water inlet interact with each other to form a third vortex on the circumference and an air swirl at the center of the circle with the accelerated flow rate of the water flowing out of the water outlet barrel.

2. The vortex water flow accelerator according to claim 1, wherein a locking interface is formed on at least one splitter plate of the plurality of splitter plates, and the small diameter end is positioned and installed at the locking interface.

3. The vortex water flow accelerator according to claim 1, wherein a middle part of the water outlet barrel retracts inward in a thin waist shape.

4. The vortex water flow accelerator according to claim 1, wherein a thickness of the spiral blade decreases along a direction from the upper edge to the lower edge.

* * * * *